US010724362B2

(12) United States Patent
Gajic et al.

(10) Patent No.: US 10,724,362 B2
(45) Date of Patent: Jul. 28, 2020

(54) ADAPTIVE POWER SAVING TELEMETRY SYSTEMS AND METHODS

(71) Applicant: NABORS DRILLING TECHNOLOGIES USA, INC., Houston, TX (US)

(72) Inventors: Bosko Gajic, Kingwood, TX (US); Keith Batke, Klein, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/210,650

(22) Filed: Dec. 5, 2018

(65) Prior Publication Data

US 2020/0182049 A1 Jun. 11, 2020

(51) Int. Cl.
*E21B 47/12* (2012.01)
*E21B 47/18* (2012.01)

(52) U.S. Cl.
CPC ..... *E21B 47/122* (2013.01); *E21B 47/18* (2013.01)

(58) Field of Classification Search
CPC ..... E21B 47/122; E21B 47/18
See application file for complete search history.

(56) References Cited

U.S. PATENT DOCUMENTS 9,810,056 B2 11/2017 Batke et al.
2011/0198076 A1* 8/2011 Villreal ..... E21B 21/08 166/250.01
2015/0247400 A1* 9/2015 Batke ..... E21B 47/12 340/853.3
2015/0275656 A1* 10/2015 Holt ..... E21B 44/00 340/855.4
2016/0223704 A1* 8/2016 Donderici ..... G01V 3/38
2019/0120023 A1* 4/2019 Ocegueda-Hernandez ..... E21B 44/00

OTHER PUBLICATIONS

U.S. Appl. No. 16/185,157, Gajic, et al., filed Nov. 9, 2018.

* cited by examiner

*Primary Examiner* — Amine Benlagsir
(74) *Attorney, Agent, or Firm* — Haynes and Boone, LLP

(57) ABSTRACT

Apparatuses, methods, and systems are described herein for transmission of measurement while drilling (MWD) data from a MWD tool to a receiver. Such apparatuses, methods, and systems may modify MWD data to allow for transmission of the modified MWD data in a manner that conserves electrical power of the MWD tool. For example, the MWD data can be modified to allow for effectively slower transmission of the data while adhering to existing transmission settings. Furthermore, a MWD tool can communicate data to modify transmission settings between the MWD tool and a rig controller. The rig controller can then adjust settings of the rig and transmit corresponding communications to the MWD tool to modify settings of the MWD tool. Such techniques allow for MWD data to be conveyed in an electrically efficient manner, reducing maintenance and recharging requirements of the MWD tool.

20 Claims, 6 Drawing Sheets

ADAPTIVE POWER SAVING TELEMETRY SYSTEMS AND METHODS

FIELD OF THE DISCLOSURE

The present apparatus, methods, and systems relate generally to drilling and particularly to improved communication techniques for providing measurement while drilling (MWD) data.

BACKGROUND OF THE DISCLOSURE

Underground drilling involves drilling a borehole through a formation deep in the Earth using a drill bit connected to a drill string. The drill bit is typically mounted on the lower end of the drill string as part of a bottom-hole assembly (BHA) and is rotated by rotating the drill string at the surface and/or by actuation of down-hole motors or turbines. A BHA may include a variety of sensors used to monitor various down-hole conditions—such as pressure, spatial orientation, temperature, or gamma ray count—that are encountered while drilling. A typical BHA will also include a telemetry system that processes signals from these sensors and transmits data to the surface. The drilling operations may be guided through MWD data obtained from the BHA. The MWD data may be obtained by the BHA and transmitted to the surface. The MWD data can then be used to understand the formations and make plans on completion, sidetracking, abandoning, further drilling, etc.

Current MWD telemetry systems require a transmitter (typically on the BHA) and a receiver (e.g., a computer at rig with attached hardware) to have matching settings in order to engage in transmission of telemetry data. Accordingly, the settings of the transmitter on the BHA typically cannot be modified without receiving a downlinked command from the rig site. Modification of settings without the transmitter receiving the downlinked command may result in lost connection if the receiver does not recognize the change in settings. Furthermore, existing telemetry systems, especially electromagnetic (EM) based telemetry, are generally configured to transmit at higher data rates. Such higher data rates will consume more power, decreasing endurance of the BHA.

However, MWD tools are typically battery powered and can only store finite energy. Thus, improved telemetry techniques that allow for conservation of battery life and, thus, increased time before recharge, are needed.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
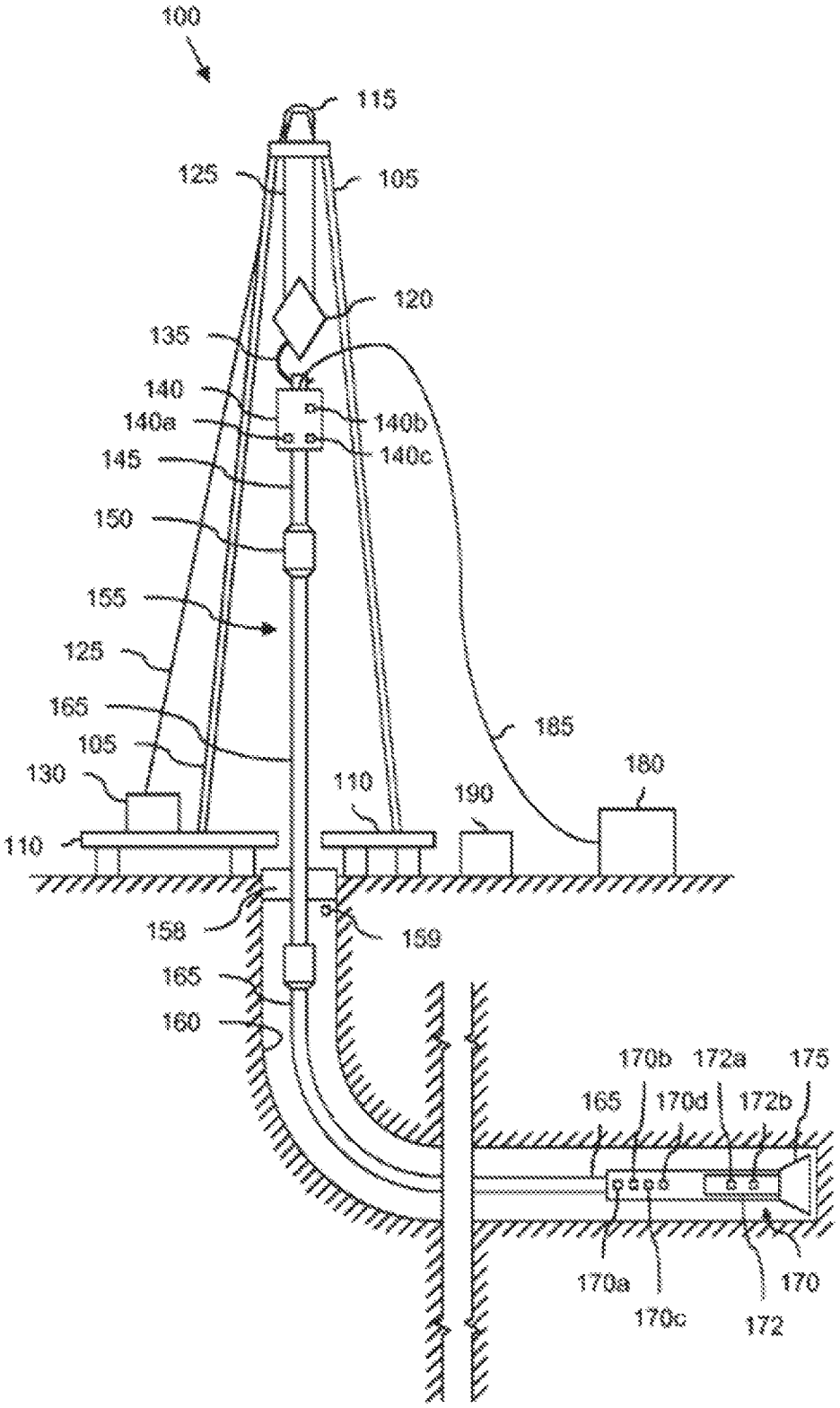
FIG. 1 is a schematic of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

MWD data are communicated between a MWD communicator and a rig communicator. Typically, a BHA generates MWD data through one or more sensors of the BHA and transmits the MWD data from a transmitter (e.g., a component of the MWD communicator) to a receiver (e.g., a component of the rig communicator) of the rig. Conventional MWD data transmission techniques are directed to faster data transmission. However, transmitting MWD data through EM based telemetry typically utilizes a large amount of power. Furthermore, the MWD communicator and rig communicator typically require regular and continuous data communications to maintain a connection and, thus, prevent disconnection between the MWD communicator and the rig communicator.

This disclosure provides apparatuses, systems, and methods for improved transmission of MWD data by modifying MWD data with time between symbols (TBS) to slow down telemetry transmission and conserve battery life (or other power usage) of the BHA. Modifying the MWD data with TBS can increase the time of transmission of MWD data while conserving battery or otherwise minimizing power usage. Furthermore, such MWD data modified with TBS may decrease the amount of data communications needed to simply maintain a connection and, thus, decrease the amount of superfluous data transmitted.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure. In another aspect (not shown), no quill is present.

The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

As depicted, the drill string 155 typically includes interconnected sections of drill pipe 165, a bottom hole assembly (BHA) 170, and a drill bit 175. The BHA 170 may include stabilizers, drill collars, and/or measurement while drilling (MWD) tools or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be fluidically and/or actually connected to the top drive 140.

The downhole MWD or wireline conveyed instruments may be configured for the evaluation of physical properties such as pressure, temperature, torque, weight-on-bit (WOB), vibration, inclination, azimuth, toolface orientation in three-dimensional space, and/or other downhole parameters. These measurements may be made downhole, stored in solid-state memory for some time, and downloaded from the instrument(s) at the surface and/or transmitted to the surface. Data transmission methods may include, for example, digitally encoding data and transmitting the encoded data to the surface, possibly as pressure pulses in the drilling fluid or mud system, acoustic transmission through the drill string 155, electronically transmitted through a wireline or wired pipe, and/or transmitted as electromagnetic (EM) pulses. MWD tools and/or other portions of the BHA 170 may have the ability to store measurements for later retrieval via wireline and/or when the BHA 170 is tripped out of the wellbore 160.

In certain examples, the BHA 170 can include a MWD communicator that provides EM transmission to a rig communicator located on the surface (e.g., within control system 190). In certain such or other examples, the transmissions may utilize phase shift key (PSK) telemetry. The systems and techniques described herein may be utilized by or utilize EM, PSK, or other types of telemetry. EM and/or PSK telemetry transmissions can be utilized at low or high frequencies. Such telemetry may consume more power when operated at higher data rates. As MWD tools can be battery powered and include finite energy, battery life and, thus, operational time of the MWD tool, can be adversely affected by transmitting a greater amount of data. Typically, there is an emphasis on providing faster transmissions that allow for greater amounts of data transmitted per unit time. However, such techniques tend to deplete battery life at greater levels, and use more power whether or not a battery is the energy source. Accordingly, the systems and techniques described herein allow for conservation of battery of MWD tools or minimized power usage and, thus, e.g., longer battery life. In certain embodiments, the systems and techniques allow for more regularly paced transmissions instead of bursts of data. For example, MWD data may be modified by TBS to slow down transmissions to a speed that conserves battery life and/or reduces power usage, but prevents disconnection between the MWD communicator and the rig communicator.

In an exemplary embodiment, the apparatus 100 may also include a rotating blow-out preventer (BOP) 158, such as if the well 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 158. The apparatus 100 may also include a surface casing annular pressure sensor 159 configured to detect the pressure in the annulus defined between, for example, the wellbore 160 (or casing therein) and the drill string 155.

In the exemplary embodiment depicted in FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig.

The apparatus 100 also includes a control system 190 configured to control or assist in the control of one or more components of the apparatus 100. For example, the control system 190 may be configured to transmit operational control signals to the drawworks 130, the top drive 140, the BHA 170 and/or the pump 180. The control system 190 may be a stand-alone component installed near the mast 105 and/or other components of the apparatus 100. In some embodiments, the control system 190 is physically displaced at a location separate and apart from the drilling rig.

The control system 190 is also configured to receive electronic signals via wired or wireless transmission techniques (also not shown in FIG. 1) from a variety of sensors and/or MWD tools included in the apparatus 100, where each sensor is configured to detect an operational characteristic or parameter. One such sensor is the surface casing annular pressure sensor 159 described above. The apparatus 100 may include a downhole annular pressure sensor **170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160**, which may also be referred to as the casing pressure, downhole casing pressure, MWD casing pressure, or downhole annular pressure.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor 170*b* that is configured for detecting shock and/or vibration in the BHA 170. The apparatus 100 may additionally or alternatively include a mud motor delta pressure (ΔP) sensor 172*a* that is configured to detect a pressure differential value or range across one or more motors 172 of the BHA 170. The one or more motors 172 may each be or include a positive displacement drilling motor that uses hydraulic power of the drilling fluid to drive the bit 175, also known as a mud motor. One or more torque sensors 172*b* may also be included in the BHA 170 for sending data to the control system 190 that is indicative of the torque applied to the bit 175 by the one or more motors 172.

The apparatus 100 may additionally or alternatively include a toolface sensor 170*c* configured to detect the current toolface orientation. The toolface sensor 170*c* may be or include a conventional or future-developed "magnetic toolface" which detects toolface orientation relative to magnetic north or true north. Alternatively, or additionally, the toolface sensor 170*c* may be or include a conventional or future-developed "gravity toolface" which detects toolface orientation relative to the Earth's gravitational field. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, draw works 130, crown or traveling block, drilling line or dead line anchor may additionally or alternatively include or otherwise be associated with a WOB sensor 140*c* (e.g., one or more sensors installed somewhere in the load path mechanisms to detect WOB, which can vary from rig-to-rig) different from the WOB sensor 170*d*. The WOB sensor 140*c* may be configured to detect a WOB value or range, where such detection may be performed at the top drive 140, draw works 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection equipment may include one or more interfaces which may be local at the well/rig site or located at another, remote location with a network link to the system.

Figure 2:
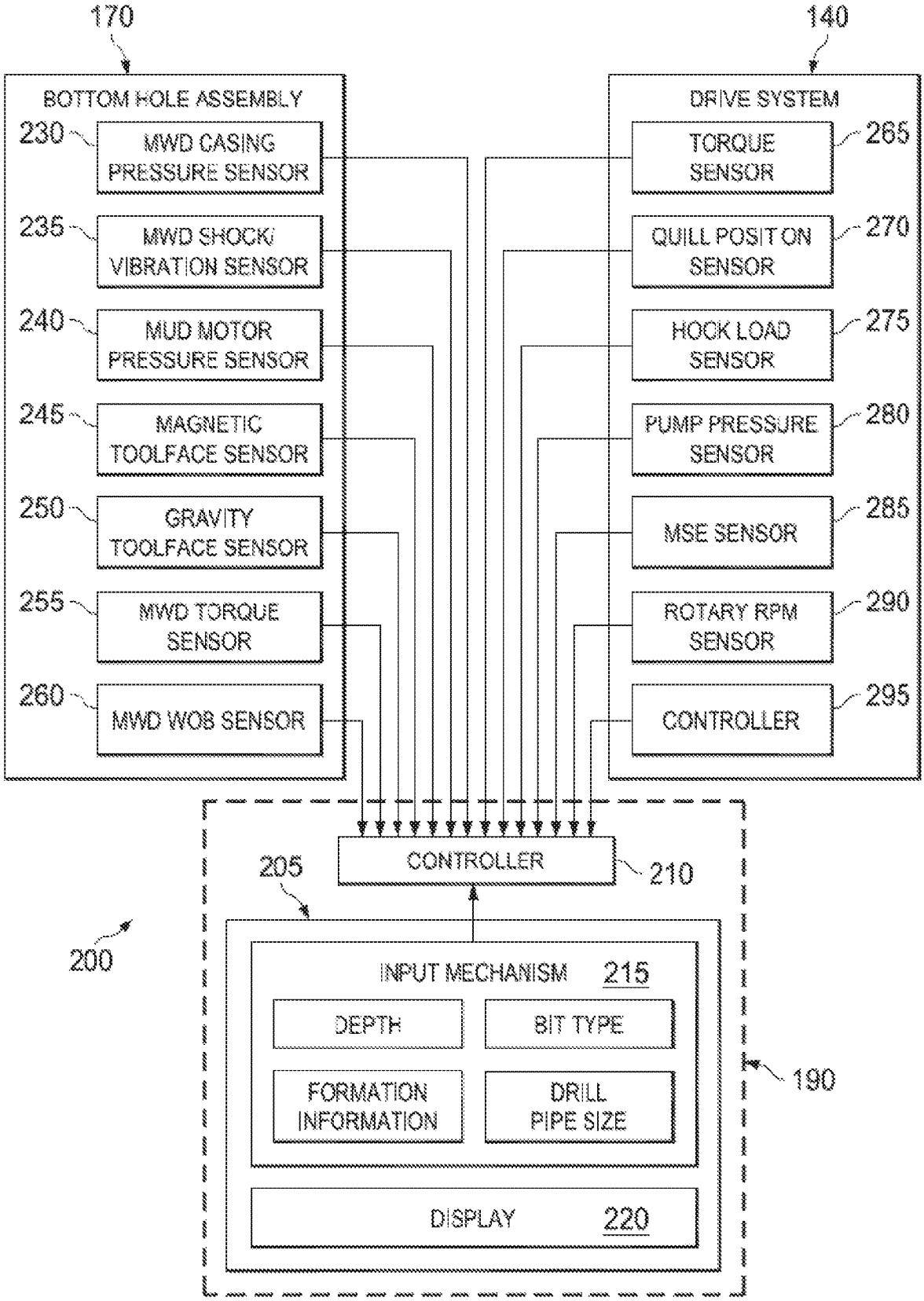
FIG. 2 is a block diagram schematic of an apparatus according to one or more aspects of the present disclosure.

FIG. 2 illustrates a block diagram of a portion of an apparatus 200 according to one or more aspects of the present disclosure. FIG. 2 shows the control system 190, the BHA 170, and the top drive 140, identified as a drive system. The apparatus 200 may be implemented within the environment and/or the apparatus shown in FIG. 1.

The control system 190 includes a user-interface 205 and a controller 210. Depending on the embodiment, these may be discrete components that are interconnected via wired or wireless technique. Alternatively, the user-interface 205 and the controller 210 may be integral components of a single system.

The user-interface 205 may include an input mechanism 215 permitting a user to input a left oscillation revolution setting and a right oscillation revolution setting. These settings control the number of revolutions of the drill string as the system controls the top drive (or other drive system) to oscillate a portion of the drill string from the top. In some embodiments, the input mechanism 215 may be used to input additional drilling settings or parameters, such as acceleration, toolface set points, rotation settings, and other set points or input data, including a torque target value, such as a previously calculated torque target value, that may determine the limits of oscillation. A user may input information relating to the drilling parameters of the drill string, such as BHA information or arrangement, drill pipe size, bit type, depth, formation information. The input mechanism 215 may include a keypad, voice-recognition apparatus, dial, button, switch, slide selector, toggle, joystick, mouse, data base and/or any other data input device available at any time to one of ordinary skill in the art. Such an input mechanism 215 may support data input from local and/or remote locations. Alternatively, or additionally, the input mechanism 215, when included, may permit user-selection of predetermined profiles, algorithms, set point values or ranges, such as via one or more drop-down menus. The data may also or alternatively be selected by the controller 210 via the execution of one or more database look-up procedures. In general, the input mechanism 215 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other techniques or systems available to those of ordinary skill in the art.

The user-interface 205 may also include a display 220 for visually presenting information to the user in textual, graphic, or video form. The display 220 may also be utilized by the user to input drilling parameters, limits, or set point data in conjunction with the input mechanism 215. For example, the input mechanism 215 may be integral to or otherwise communicably coupled with the display 220.

In one example, the controller 210 may include a plurality of pre-stored selectable oscillation profiles that may be used to control the top drive or other drive system. The pre-stored selectable profiles may include a right rotational revolution value and a left rotational revolution value. The profile may include, in one example, 5.0 rotations to the right and −3.3 rotations to the left. These values are preferably measured from a central or neutral rotation.

In addition to having a plurality of oscillation profiles, the controller 210 includes a memory with instructions for performing a process to select the profile. In some embodiments, the profile is a simply one of either a right (i.e., clockwise) revolution setting and a left (i.e., counterclockwise) revolution setting. Accordingly, the controller 210 may include instructions and capability to select a pre-established profile including, for example, a right rotation value and a left rotation value. Because some rotational values may be more effective than others in particular drilling scenarios, the controller 210 may be arranged to identify the rotational values that provide a suitable level, and preferably an optimal level, of drilling speed. The controller 210 may be arranged to receive data or information from the user, the bottom hole assembly 170, and/or the top drive 140 and process the information to select an oscillation profile that might enable effective and efficient drilling.

The BHA 170 may include one or more sensors, typically a plurality of sensors, located and configured about the BHA to detect parameters relating to the drilling environment, the BHA condition and orientation, and other information. In the embodiment shown in FIG. 2, the BHA 170 includes an MWD casing pressure sensor 230 that is configured to detect an annular pressure value or range at or near the MWD portion of the BHA 170. The casing pressure data detected via the MWD casing pressure sensor 230 may be sent via electronic signal to the controller 210 via wired or wireless transmission.

The BHA 170 may also include an MWD shock/vibration sensor 235 that is configured to detect shock and/or vibration in the MWD portion of the BHA 170. The shock/vibration data detected via the MWD shock/vibration sensor 235 may be sent via electronic signal to the controller 210 via wired or wireless transmission.

The BHA 170 may also include a mud motor ΔP sensor 240 that is configured to detect a pressure differential value or range across the mud motor of the BHA 170. The pressure differential data detected via the mud motor ΔP sensor 240 may be sent via electronic signal to the controller 210 via wired or wireless transmission. The mud motor ΔP may be alternatively or additionally calculated, detected, or otherwise determined at the surface, such as by calculating the difference between the surface standpipe pressure just off-bottom and pressure once the bit touches bottom and starts drilling and experiencing torque.

The BHA 170 may also include a magnetic toolface sensor 245 and a gravity toolface sensor 250 that are cooperatively configured to detect the current toolface. The magnetic toolface sensor 245 may be or include a conventional or future-developed magnetic toolface sensor which detects toolface orientation relative to magnetic north or true north. The gravity toolface sensor 250 may be or include a conventional or future-developed gravity toolface sensor which detects toolface orientation relative to the Earth's gravitational field. In an exemplary embodiment, the magnetic toolface sensor 245 may detect the current toolface when the end of the wellbore is less than about 7° from vertical, and the gravity toolface sensor 250 may detect the current toolface when the end of the wellbore is greater than about 7° from vertical. However, other toolface sensors may also be utilized within the scope of the present disclosure that may be more or less precise or have the same degree of precision, including non-magnetic toolface sensors and non-gravitational inclination sensors. In any case, the toolface orientation detected via the one or more toolface sensors (e.g., sensors 245 and/or 250) may be sent via electronic signal to the controller 210 via wired or wireless transmission.

The BHA 170 may also include an MWD torque sensor 255 that is configured to detect a value or range of values for torque applied to the bit by the motor(s) of the BHA 170. The torque data detected via the MWD torque sensor 255 may be sent via electronic signal to the controller 210 via wired or wireless transmission.

The BHA 170 may also include an MWD weight-on-bit (WOB) sensor 260 that is configured to detect a value or range of values for WOB at or near the BHA 170. The WOB data detected via the MWD WOB sensor 260 may be sent to the controller 210 via one or more signals, such as one or more electronic signals (e.g., wired or wireless transmission) or mud pulse telemetry, or any combination thereof.

The top drive 140 may also or alternatively include one or more sensors or detectors that provide information that may be considered by the controller 210 when it selects the oscillation profile. In this embodiment, the top drive 140 includes a rotary torque sensor 265 that is configured to detect a value or range of the reactive torsion of the quill 145 or drill string 155. The top drive 140 also includes a quill position sensor 270 that is configured to detect a value or range of the rotational position of the quill, such as relative to true north or another stationary reference. The rotary torque and quill position data detected via sensors 265 and 270, respectively, may be sent via electronic signal to the controller 210 via wired or wireless transmission.

The top drive 140 may also include a hook load sensor 275, a pump pressure sensor or gauge 280, a mechanical specific energy (MSE) sensor 285, and a rotary RPM sensor 290.

The hook load sensor 275 detects the load on the hook 135 as it suspends the top drive 140 and the drill string 155. The hook load detected via the hook load sensor 275 may be sent via electronic signal to the controller 210 via wired or wireless transmission.

The pump pressure sensor or gauge 280 is configured to detect the pressure of the pump providing mud or otherwise powering the BHA from the surface. The pump pressure detected by the pump sensor pressure or gauge 280 may be sent via electronic signal to the controller 210 via wired or wireless transmission.

The mechanical specific energy (MSE) sensor 285 is configured to detect the MSE representing the amount of energy required per unit volume of drilled rock. In some embodiments, the MSE is not directly sensed, but is calculated based on sensed data at the controller 210 or other controller about the apparatus 100.

The rotary RPM sensor 290 is configured to detect the rotary RPM of the drill string. This may be measured at the top drive or elsewhere, such as at surface portion of the drill string. The RPM detected by the RPM sensor 290 may be sent via electronic signal to the controller 210 via wired or wireless transmission.

In FIG. 2, the top drive 140 also includes a controller 295 and/or other device for controlling the rotational position, speed and direction of the quill 145 or other drill string component coupled to the top drive 140 (such as the quill 145 shown in FIG. 1). Depending on the embodiment, the controller 295 may be integral with or may form a part of the controller 210.

The controller 210 is configured to receive detected information (i.e., measured or calculated) from the user-interface 205, the BHA 170, and/or the top drive 140, and utilize such information to continuously, periodically, or otherwise operate to determine and identify an oscillation regime target, such as a target rotation parameter having improved effectiveness. The controller 210 may be further configured to generate a control signal, such as via intelligent adaptive control, and provide the control signal to the top drive 140 to adjust and/or maintain the oscillation profile to most effectively perform a drilling operation. Consequently, the controller 295 of the top drive 140 may be configured to modify the number of rotations in an oscillation, the torque level threshold, or other oscillation regime target. It should be understood the number of rotations used at any point in the present disclosure may be a whole or fractional number.

Figure 3:
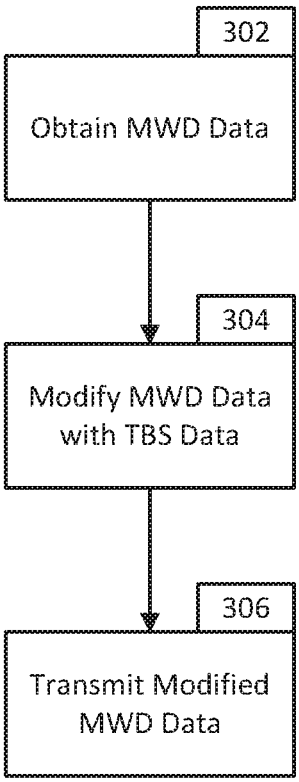
FIG. 3 is a flow-chart diagram detailing at least a portion of a method according to one or more aspects of the present disclosure.

FIG. 3 is a flow-chart diagram detailing at least a portion of a method according to one or more aspects of the present disclosure. FIG. 3 may illustrate a technique of transmitting MWD data that conserves battery life of a BHA. FIG. 3 illustrates an example technique where MWD data may be modified with TBS to allow for battery savings and/or general reduction in power usage.

In block 302, MWD data is obtained by the BHA. The MWD data may be, for example, data related to downhole drilling conditions, orientation of the BHA, drilling progress, and/or other data associated with the BHA and/or drilling operations. Some or all of the MWD data may be configured to be transmitted to the surface (e.g., to a control station at the surface).

In block 304, the MWD data may be modified with TBS. Such modification may lengthen the transmission time of MWD data while conserving battery life or otherwise reducing power consumption. For example, such TBS may cause a delay between transmission of various portions of the MWD data and may, for example, include additional spaces or other symbols between portions of MWD data. Such spaces or other symbols may not be transmitted (e.g., may not cause transmission of data from the MWD communicator to the rig communicator) and, thus, may not consume battery life, or may consume only minimal amounts of battery life or power. Modifying the MWD data to lengthen the time of transmission may, for example, decrease or eliminate data transmitted or re-transmitted to simply maintain connection or verify transmission between the MWD communicator and the rig communicator and/or may allow for operation of the MWD communicator at a slower and less power intensive transmission speed.

In block 306, the modified MWD data may be communicated. For example, after the controller of the BHA has modified the MWD data in block 306, a downhole transmitter (e.g., a transmitter of the MWD communicator) may communicate the modified MWD data to a receiver (e.g., a receiver of the rig communicator). The receiver may be disposed on the surface and/or be a part of the controller of the rig that controls operation of the BHA and/or be disposed in an adjacent well with the receiver being connected by wireline to the surface. Operation of the rig may then be controlled or adjusted according to the modified MWD data.

Figure 4:
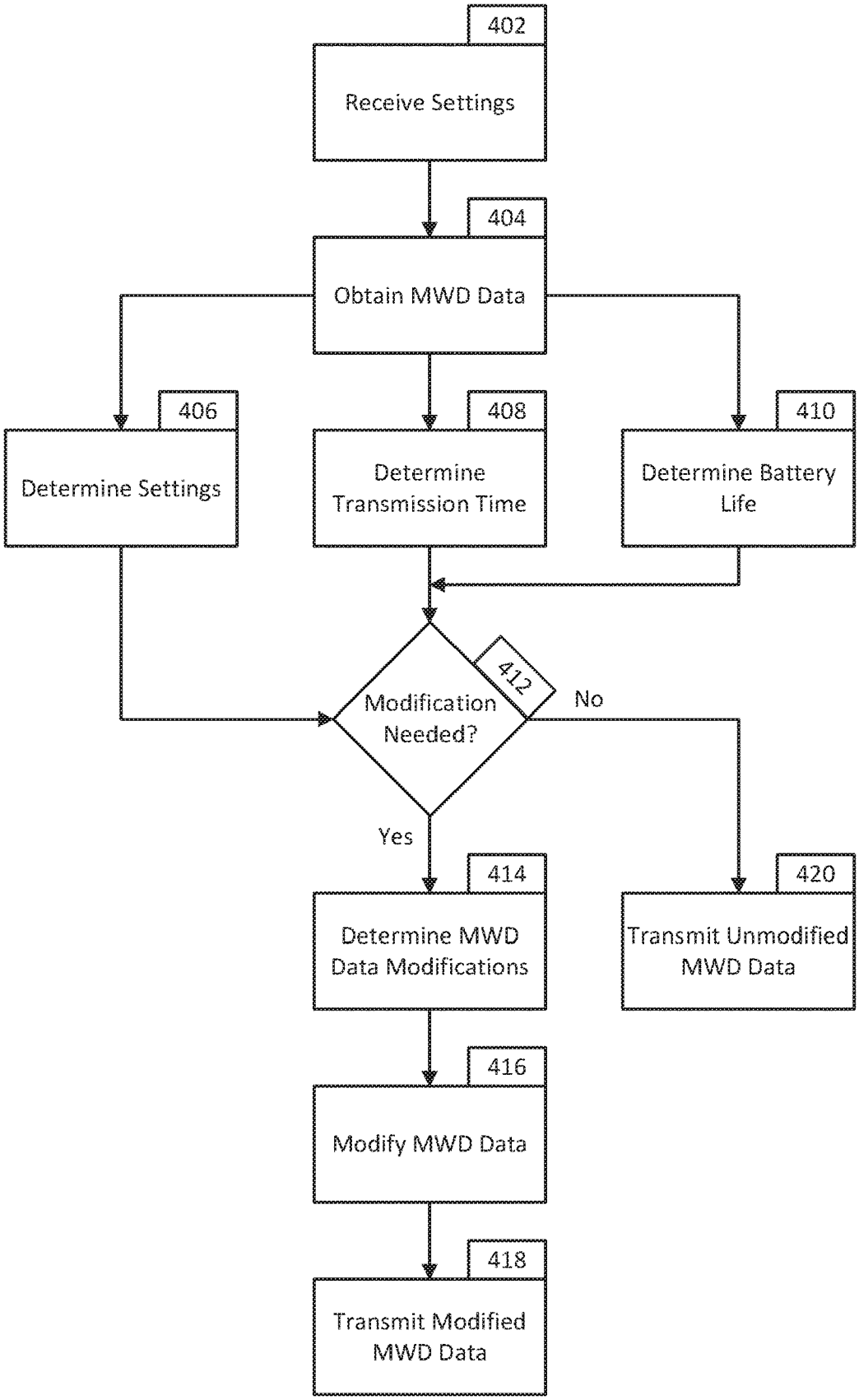
FIG. 4 is a flow-chart diagram detailing further aspects of at least a portion of a method according to one or more aspects of the present disclosure.

FIG. 4 is a flow-chart diagram detailing further aspects of at least a portion of a method according to one or more aspects of the present disclosure. FIG. 4 further details the technique of modifying MWD data to conserve battery life and/or otherwise reduce power consumption of a BHA as illustrated in FIG. 3. The techniques described in FIGS. 3-6 may be performed by any component of a BHA, such as a controller located on the BHA as well as a MWD communicator of the BHA.

In block 402, settings may be received. Such settings may be, for example, settings for obtaining data by one or more sensors of the BHA as well as settings for communication of data between the MWD communicator and the rig communicator. In certain embodiments, the MWD tool of the BHA transmits data according to the settings received from the controller (e.g., controller at the surface) and cannot modify telemetry in manners contradictory to the settings. Thus, the MWD tool cannot modify MWD data in ways not allowed by the settings, as such modifications may render the rig communicator unable to receive and/or decode MWD data from the MWD communicator.

In block 404, the MWD data may be obtained. The MWD data may be obtained in block 404 in a manner similar to that detailed for block 302 of FIG. 3. In blocks 406-410, various factors and conditions may be determined. Such factors may be used, in block 412, to determine if the MWD data should be modified.

In block 406, settings of the MWD tool are determined. Such settings can include settings for transmission of MWD data from the MWD communicator to the rig communicator (e.g., the frequency, speed, power, and/or other settings used in such transmissions). Such transmission settings may form the baseline for any modified MWD data. That is, though the MWD data may be modified with TBS, the resulting modifications will still be according to the settings and, thus, will not violate the settings specified. In a certain embodiment, the MWD data may be modified to allow for transmission of data at transmission rates that are effectively slower than that of the settings. That is, if the settings are determined to operate the MWD communicator and/or MWD tool at transmission rates that are faster than needed, the MWD data may be modified to effectively transmit the data at slower rates while still conforming to the settings.

Additionally, the time of the last update to the settings can also be determined. In certain embodiments, if the settings have been recently updated, the controller and/or MWD communicator may be more unlikely to modify the MWD data, while more out of date settings (e.g., if the settings are older than a threshold age) may lead to the controller and/or MWD communicator modifying and/or being more likely to modify the MWD data.

In block 408, the maximum time available for transmission of the MWD data may be determined. In certain embodiments, the MWD data may need to be transmitted in a set time period. That is, the MWD communicator may transmit data set 1 and data set 2 in a 60 second time period. As the minimum amount of time required to transmit data set 2 is 30 seconds, in such an example, data set 1 may be transmitted in a maximum of 30 seconds. In certain other embodiments, there may be a maximum time allowed for one data set or for multiple data sets.

If the maximum time allowed is greater than the time required to transmit the unmodified MWD data, the MWD data may be modified to be longer. The modified MWD data may be equal to or less than the maximum time allowed. Additionally, if the transmission time allowed is for multiple data sets, one or more data sets may be modified to allow for a more even or substantially even transmission of data. That is, such data sets may all be transmitted in a manner where each time period communicates substantially similar amounts of data (e.g., within about 25%) between the MWD communicator and the rig communicator. Accordingly, bursts of data may then be avoided.

In block 410, the remaining battery life of the MWD tool and/or the BHA may be determined. In certain embodiments, the MWD data may be modified if the battery life remaining is below a threshold amount. The threshold amount may be set to provide a level below which the BHA may attempt to lengthen the time of operation of the MWD tool. In other embodiments, the MWD data may be modified regardless of remaining battery life to provide for the longest possible operational timeframe.

In a certain embodiment, objectives may be determined. For example, the MWD tool may determine that, at current transmission rates, the remaining battery life will not finish transmitting MWD data before battery life is depleted. However, if the MWD data is modified, the modified data may conserve battery life and may finish transmitting before battery is depleted. In such an embodiment, the MWD data may accordingly be modified in response to the determination.

In block 412, whether the MWD data should be modified is determined. The determinations of blocks 406-410, as well as other factors, may be used to determine whether modification is needed. If modification is not needed, the unmodified MWD data may be transmitted to the rig communicator in block 420. If the MWD data is to be modified, the process may proceed to block 414.

In block 414, modifications for the MWD data may be determined and the MWD data may be modified in block 416. For example, the MWD data may be modified with TBS inserted between a first MWD data portion and a second MWD data portion. Such data portions may be a first telemetry symbol and a second telemetry symbol, each telemetry symbol configured to indicate a measurement by the MWD tool. The TBS may delay transmission of the second MWD data portion after the first MWD data portion and, accordingly, increase the amount of time needed to transmit the modified MWD data.

Such TBS may, for example, be "spaces" between data portions as well as other symbols and/or data that decrease transmission speeds. In certain embodiments, such symbols and/or data may cause the MWD communicator to pause transmitting for a period of time. The TBS may be configured so that such a period of time is less than an amount of time that would cause the MWD communicator and the rig communicator to disconnect from each other, to maintain connection between the MWD communicator and the rig communicator. In other embodiments, the TBS may modify the MWD data so that transmission of the modified MWD data is effectively at a desired rate of transmission that is slower than the settings of the MWD tool.

In certain embodiments, the MWD communicator and rig communicator may communicate data and/or settings through a communication technique that allows for modification of MWD data with TBS. The rig communicator in such a technique may, for example, recognize that "spaces" or another symbol is specifically inserted by the MWD data to pause and/or delay transmission (e.g., may indicate that the MWD communicator should delay transmission by 5 seconds). The MWD communicator may then delay transmission according to the space and/or symbol, which may be inserted by the rig communicator, a controller, or another device. In certain such embodiments, the rig communicator may be accordingly configured to accommodate such delays. For example, the rig communicator may be configured to maintain a connection with the MWD communicator despite pauses in transmission of data. Thus, the MWD communicator may be configured to, for example, insert spaces causing a maximum delay of 20 seconds between symbols. The rig communicator may accordingly be configured to, for example, maintain a connection for 20 seconds or longer despite receiving no data from the MWD communicator. The rig communicator may, thus, be configured to accommodate the maximum delay that may be inserted between symbols.

Decreasing the speed of transmission of modified MWD data may result in the MWD communicator operating at lower power outputs, decrease the amount of "maintenance" transmissions that are needed to maintain a connection (e.g., using a handshake sequence, or retransmitting a portion of the data to verify receipt by the rig communicator), decrease the power requirements of secondary systems (e.g., cooling systems), and/or conserve battery in other manners. The modified MWD data may be transmitted to the rig communicator in block 418. By using the systems and method described herein, a MWD tool can transmit data at lower power levels without changing transmission settings.

Alternatively, or in addition to, modifying MWD data with TBS, further techniques may allow for changes to settings of the MWD communicator and/or the rig communicator. In certain such techniques, the changes may allow for battery savings to extend the endurance of the MWD tool and/or the BHA. In certain additional embodiments, the rig and/or the rig communicator may determine, from data provided by the MWD communicator, MWD tool, and/or the BHA, one or more changes to the settings of the MWD communicator, the transmitter, the rig communicator, and/or the rig communicator. Such changes may be made to the MWD communicator and corresponding data may be sent to the rig communicator to change the settings of the rig communicator as needed or in advance of the time such change is needed.

Figure 5:
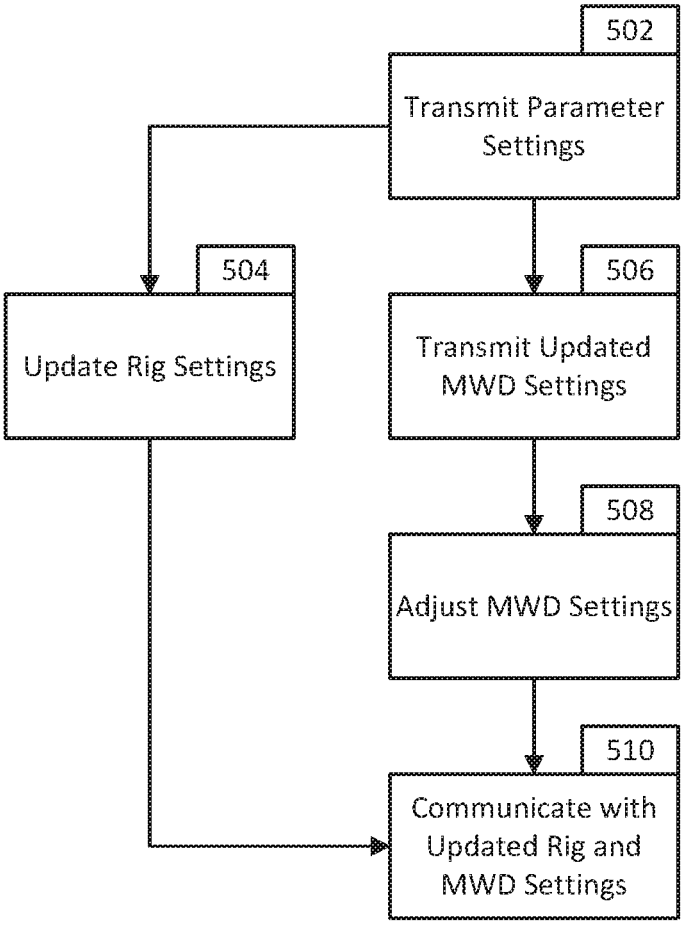
FIG. 5 is a flow-chart diagram detailing at least a portion of a further method according to one or more aspects of the present disclosure.

FIG. 5 is a flow-chart diagram detailing at least a portion of a further method according to one or more aspects of the present disclosure. As described herein, a MWD communicator located on a BHA and a received located on a rig may communicate data via, for example, EM base telemetry, mud pulses, radio communications, and/or any other available type of communications technique. The communications techniques may allow for data (e.g., MWD data) to be communicated.

In block 502, the MWD communicator and/or MWD tool transmits parameter settings to the rig communicator. The parameters settings may be transmitted as data near the beginning, in the middle, or in some other portion of MWD data. For example, the parameter settings can be a part of the MWD data or separate from the MWD data and can define the settings for communicating a later portion of the MWD data. Thus, the parameter settings may be transmitted during a first time period and may indicate that the transmission settings of the rig communicator and/or the MWD communicator be adjusted during a second time period after the first time period. The second time period may be, for example, immediately after the first time period, after a pre-set amount of time, at a pre-selected time after the first time period, or after a pre-selected drilling event occurs, or as otherwise noted herein.

In certain embodiments, the parameter settings may include data that can define settings for communications between the MWD communicator and the rig communicator. Such settings can be defined for one transmission (e.g., one batch of MWD data), for a set amount of time, or until settings are changed. In certain embodiments, the parameter settings may be directed to one or more settings associated with telemetry channels, pulse width, frequency, or TBS settings. Thus, the parameter settings may specify a change of one or more of telemetry channels, pulse width, frequency, or TBS settings. Such settings may increase or decrease transmission speeds, conserve battery, and/or allow for communications over channels and/or techniques that result in less interference.

In certain embodiments, the parameter settings may be determined by the BHA, MWD tool, and/or MWD communicator in response to transmission requirements. Thus, for example, MWD data that requires a faster transmission speed (e.g., may contain greater than average amounts of data) may transmit parameter settings that set communications between the MWD communicator and rig communicator at higher speeds, while a low battery situation may result in the transmission of parameter settings that set communications at a slower, but lower power, rate of speed.

Such requirements may be determined per batch of MWD data, in response to current situations (e.g., battery levels), due to downhole conditions, according to a preset schedule, and/or according to other factors.

The parameter settings may be provided by the MWD communicator to the rig communicator. Once received, the rig communicator and/or a rig controller may determine the instructions of the parameter settings, including changes to settings, the time of change, the time period for the new settings, and other information. The rig communicator and/or other portions of the rig may be updated by selecting appropriate rig settings in block 504. Such rig settings may include appropriate adjustments, if any (e.g., in certain situations the rig communicator and/or the rig controller may determine that adjustment to the settings or selection of another predetermined setting is unnecessary and may continue operating with the previous settings). Adjustments may be determined according to the parameter settings (e.g., adjustments may be determined in response to transmission requirements and, thus, such settings may be customized due to transmission requirements) or may include selection of one or more predetermined settings chosen according to the parameter settings.

The rig may also transmit updated MWD settings to the BHA and/or MWD tool in block 506. Such updated MWD settings may include none, one, some, or all of the same adjustments as that made to the rig settings in block 504. In certain embodiments, the updated MWD settings may also include further adjustments to the MWD tool (e.g., to run at a higher or slower signal strength in response to changes in distance between the MWD tool and the rig) where the rig settings are already set as desired.

The MWD tool and/or BHA may receive the updated MWD settings. In response, in block 508, the MWD tool and/or BHA may determine the appropriate adjustments, if any, and perform the adjustments. Such adjustments may include selection of MWD settings that include changes to settings, the time of change, the time period for the new settings, and/or other adjustments. In certain embodiments, the MWD communicator and/or the MWD tool may predict the updated rig settings (e.g., based on the parameter settings transmitted by the MWD communicator and/or the MWD tool). In such embodiments, updated MWD settings may not be transmitted to the MWD communicator and/or the MWD tool. Instead, the MWD communicator and/or the MWD tool may predict any adjustments or updated settings in block 508 without receiving updated MWD settings from the rig.

In certain situations, selection of the MWD settings may include determining that adjustment to the settings or choosing another predetermined setting is unnecessary and, thus, the MWD tool and/or BHA may continue operating with the previous settings. The adjusted rig and MWD settings are preferably synchronized so that the MWD communicator and rig communicator may communicate. In one preferred embodiment, this synchronization occurs while avoiding any concurrent handshake or further check to ensure the settings are synchronized. This is because the settings are preferably adjusted in advance according to the one or more parameter settings as needed to ensure such synchronization.

In certain embodiments, blocks 504-508 may be performed during a second time period after block 502. As described herein, in certain embodiments, the parameter settings may specify the second time period while, in other embodiments, the controller may determine an appropriate second time period to update the settings (e.g., between the transmission of batches of MWD data). In certain embodiments, updating of rig and MWD settings, as performed in blocks 504 and 508, may occur substantially simultaneously (e.g., the time period for update may overlap). In such an embodiment, the updated MWD settings transmitted in block 506 may be transmitted before the rig settings and MWD settings are updated, in blocks 504 and 508. The updated MWD settings may specify a time period for update, and such a time period may be, for example, the second time period (e.g., resulting in the rig and MWD settings being updated substantially simultaneously).

In block 510, the updated settings for the rig and MWD tool may include synchronized settings that allow for communication between the rig and the MWD tool (e.g., between the rig communicator and MWD communicator). The rig and MWD tool may then communicate using the updated settings.

Figure 6:
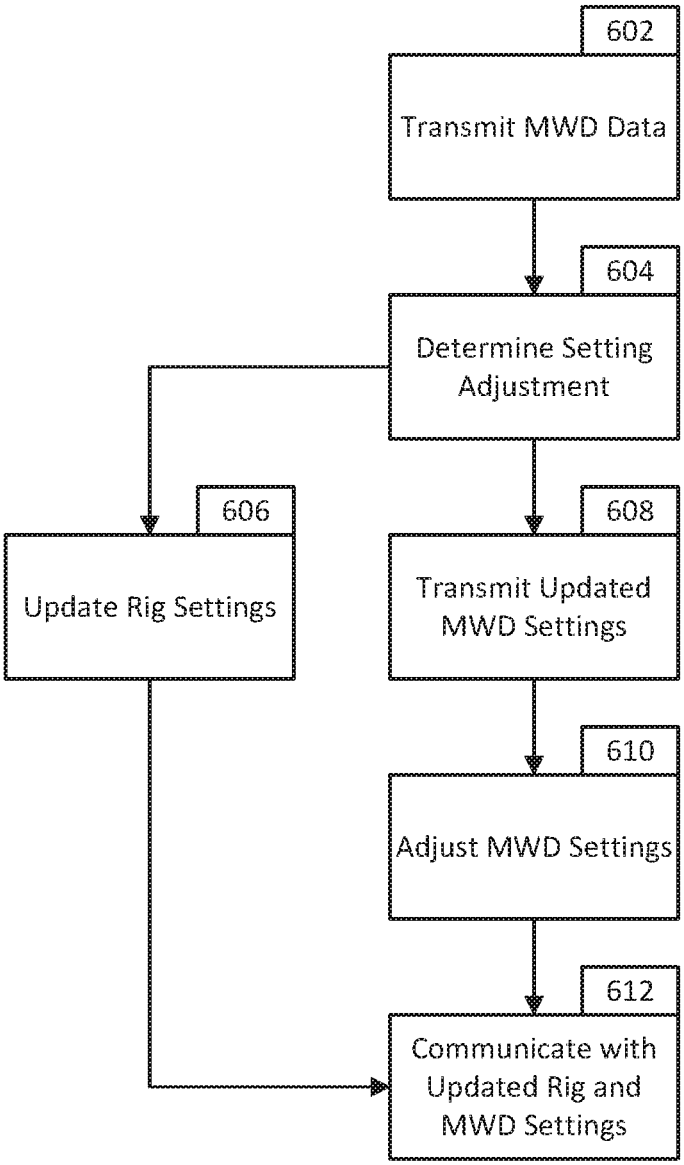
FIG. 6 is a flow-chart diagram detailing at least a portion of another method according to one or more aspects of the present disclosure.

FIG. 6 is a flow-chart diagram detailing at least a portion of another method according to one or more aspects of the present disclosure. FIG. 6 illustrates an exemplary technique where setting changes are implicit in MWD data and/or determined by the rig controller from the MWD data, rather than explicitly requested by parameter settings transmitted from the MWD tool.

In block 602, MWD data may be transmitted from the MWD tool to the rig. In certain embodiments, the MWD data may include TBS and/or be modified by TBS to effectively reduce the rate of transmission of the MWD communicator. The MWD data may be received in block 604 and appropriate setting adjustments may be determined from the MWD data.

For example, the MWD data may be modified with TBS to effectively slow the rate of transmission. The rig controller may determine that the rate of transmission of the MWD data is being effectively slowed by the TBS and, in response, determine that the setting for the transmission rate should be modified to slow down the transmission rate (e.g., to that of the effective rate as modified by TBS). In another example, the rig controller may determine that the modification of the MWD data by TBS is intended to save battery life. The rig controller may then provide setting changes that conserve battery life. For example, the output of transmission may be set at a lower level, the telemetry channel may be changed, and/or the pulse width, frequency, and/or other settings may be modified to a setting that conserves battery life. In a certain embodiment, such setting changes may be determined on an individual basis (e.g., customized according to the individual situation). In another embodiment, determining such setting changes may include choosing one or more predetermined settings. Thus, the rig controller may first be operating according to a first predetermined setting that maximizes transmission speeds, but may determine that the rate of transmission of the MWD data is being effectively slowed by the TBS. In response, the rig controller may then choose a second predetermined setting that reduces transmission speeds, but increases battery life.

Based on the determination of block 604, the rig settings may be updated in block 606, updated MWD settings transmitted from the rig to the MWD tool in block 608, and the MWD communicator and/or rig communicator accordingly updated in block 610. The rig and MWD tool may communicate using the updated settings in block 612. Blocks 606-12 may be similar to blocks 504-10 of FIG. 5. In certain embodiments where, for example, the settings of the MWD tool is adjusted to operate at a slower rate of transmission, the modification of MWD data with TBS may accordingly be changed to accommodate the slower base rate of transmission. Thus, for example, upon changing the MWD tool to a slower rate of transmission, the MWD tool may change the process of modifying MWD data with TBS by, for example, ceasing to insert or inserting less TBS, to reflect the slower rate of transmission. Additionally, in certain situations, only one of the MWD settings or the rig settings may be updated (e.g., may be changed by determining new settings and adjusting the settings, or by selection of another predetermined setting). In such situations, updated settings may be provided to the MWD or the rig that is being updated, or updated settings may be provided to both the MWD and the rig, but with one of the updates (e.g., to that of the MWD or the rig) indicating unchanged settings.

As described herein, "MWD tool," "MWD communicator," and "transmitter" may refer to any portion of the BHA that is configured to determine or receive MWD data, communicate MWD data to a controller on the surface or on the rig, and/or perform other operations associated with the processing or communication of MWD data. The MWD tool, MWD communicator, and/or the transmitter may include one or more controllers and/or transmitting/receiving devices. "Receiver," "rig communicator," and "rig controller" may refer to any portion of the rig and/or control systems configured to receive the MWD data and/or provide settings that govern operation of the MWD tool, transmitter, or other aspect of the BHA. The rig controller, rig communicator, and/or receiver may also include one or more controllers and/or transmitting/receiving devices.

In view of all of the above and the figures, one of ordinary skill in the art will readily recognize that the present disclosure introduces a system that may include a MWD communicator configured to communicate data according to MWD transmission settings and a rig communicator configured to communicate data according to rig transmission settings. The MWD communicator and the rig communicator may be configured to communicate when the MWD transmission settings and the rig transmission settings are synchronized. The rig communicator may be configured to provide setting data to the MWD communicator to define the MWD transmission settings. Furthermore, the MWD communicator and/or the rig communicator are further configured to transmit, from the MWD communicator to the rig communicator, parameter data associated with transmission settings, adjust the rig transmission settings in response to the rig communicator receiving the parameter data, transmit, from the rig communicator to the MWD communicator, updated setting data in response to receiving the parameter data, and adjust the MWD transmission settings in response to the MWD communicator receiving the updated setting data, where the adjusted rig transmission settings and the adjusted MWD transmission settings are synchronized.

In an aspect of the invention, the MWD communicator and/or the rig communicator may be further configured to communicate data between the MWD communicator and the rig communicator according to the adjusted rig transmission settings and the adjusted MWD transmission settings.

In another aspect of the invention, the parameter data may be transmitted during a first time period and the adjusting the rig transmission settings and the transmitting the updated setting data may be performed during a second time period after the first time period. In a further aspect of the invention, the parameter data may define the second time period.

In another aspect of the invention, the parameter data may be a portion of MWD data transmitted from the MWD communicator to the rig communicator.

In another aspect of the invention, the parameter data may be configured to adjust a setting associated with power usage of the rig communicator and/or the MWD communicator.

In another aspect of the invention, the MWD communicator and the rig communicator may be configured to communicate via electromagnetic and/or mud pulse communications.

In another aspect of the invention, the adjusted rig transmission settings and/or the adjusted MWD transmission settings may include one or more of changed telemetry channels, changed pulse width, changed frequency, or adjusted time between symbols.

In another aspect of the invention, a system may be introduced that may include a MWD communicator configured to communicate data according to MWD transmission settings and a rig communicator configured to communicate data according to rig transmission settings. The MWD communicator and the rig communicator may be configured to communicate when the MWD transmission settings and the rig transmission settings are synchronized. The rig communicator may be configured to provide setting data to the MWD communicator to define the MWD transmission settings. The MWD communicator and/or the rig communicator may be further configured to transmit, from the MWD communicator to the rig communicator, MWD data, determine, from the MWD data received by the rig communicator, a rig transmission setting adjustment, adjust the rig transmission settings according to the rig transmission setting adjustment, transmit, from the rig communicator to the MWD communicator, updated setting data in response to the adjusting the rig transmission settings, and adjust the MWD transmission settings in response to the MWD communicator receiving the updated setting data. The adjusted rig transmission settings and the adjusted MWD transmission settings may be synchronized.

In an aspect of the invention, the MWD communicator and/or the rig communicator may be further configured to communicate data between the MWD communicator and the rig communicator according to the adjusted rig transmission settings and the adjusted MWD transmission settings.

In another aspect of the invention, the MWD data may include delays caused by time between symbols (TBS) inserted into the MWD data. In a further aspect, the rig communicator may be further configured to identify the delays caused by the TBS and determine the rig transmission setting adjustment in response to the identifying the delays caused by the TBS. In another aspect, the delays may be between portions of the MWD data. In yet another aspect, the TBS may effectively change a transmission rate of the MWD data to a first data rate, and the adjusted rig transmission settings and the adjusted MWD transmission settings may cause the rig communicator and the MWD communicator to communicate at a second data rate substantially similar to the first data rate. In a further aspect, the TBS may be inserted into the MWD data in response to a battery level of the MWD communicator.

In another aspect of the invention, the adjusted rig transmission settings and/or the adjusted MWD transmission settings may include one or more of changed telemetry channels, changed pulse width, changed frequency, or adjusted time between symbols.

In another aspect of the invention, a method may be introduced that may include transmitting, from a MWD communicator to a rig communicator, parameter data associated with transmission settings, where the parameter data includes instructions for the rig communicator to adjust rig transmission settings and for the rig communicator to transmit updated setting data to the MWD communicator, receiving, with the MWD communicator, the updated setting data from the rig communicator in response to the transmitting the parameter data, and adjusting the MWD transmission settings in response to the receiving the updated setting data, where the adjusted MWD transmission settings and an adjusted rig transmission settings are synchronized.

In an aspect of the invention, the parameter data may be transmitted during a first time period and the updated setting data may be received during a second time period after the first time period, where the parameter data defines the second time period.

In another aspect of the invention, the parameter data may be a portion of MWD data transmitted from the MWD communicator to the rig communicator.

In another aspect of the invention, the parameter data may be configured to adjust a setting associated with power usage of the rig communicator and/or the MWD communicator.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A system comprising:

a measurement while drilling (MWD) transceiver configured to communicate MWD data according to one or more MWD transmission settings; and a rig transceiver configured to communicate data according to one or more rig transmission settings, wherein the MWD transceiver and the rig transceiver are configured to communicate when the one or more MWD transmission settings and the one or more rig transmission settings are synchronized, and wherein the MWD transceiver and/or the rig transceiver are further configured to:

transmit, from the MWD transceiver to the rig transceiver, parameter data associated with transmission settings;

select the one or more rig transmission settings in response to the rig transceiver receiving the parameter data; and select the one or more MWD transmission settings in response to receiving the parameter data, wherein the selected one or more rig transmission settings and the selected one or more MWD transmission settings are synchronized.

2. The system of claim 1, wherein the rig transceiver is configured to provide setting data to the MWD transceiver to define the one or more MWD transmission settings, and wherein the MWD transceiver and/or the rig transceiver are further configured to:

transmit current setting data from the rig transceiver to the MWD transceiver to define the one or more MWD transmission settings, wherein the current setting data is transmitted in response to the rig transceiver receiving the parameter data, and wherein the one or more MWD transmission settings is selected in response to the MWD transceiver receiving the current setting data; and communicate data between the MWD transceiver and the rig transceiver according to the selected one or more rig transmission settings and the selected one or more MWD transmission settings.

3. The system of claim 2, wherein the parameter data is transmitted during a first time period and the selecting the one or more rig transmission settings and the transmitting the current setting data are performed during a second time period after the first time period.

4. The system of claim 3, wherein the parameter data defines the second time period.

5. The system of claim 1, wherein the parameter data is a portion of the MWD data transmitted from the MWD transceiver to the rig transceiver.

6. The system of claim 1, wherein the parameter data is configured to adjust a setting associated with power usage of the rig transceiver and/or the MWD transceiver.

7. The system of claim 1, wherein the MWD transceiver and the rig transceiver are configured to communicate via electromagnetic and/or mud pulse communications.

8. The system of claim 1, wherein the selected one or more rig transmission settings and/or the selected one or more MWD transmission settings comprise one or more of changed telemetry channels, changed pulse width, changed frequency, or adjusted time between symbols.

9. A system comprising:

a measurement while drilling (MWD) transceiver MWD communicator configured to communicate MWD data according to one or more MWD transmission settings; and a rig transceiver configured to communicate data according to one or more rig transmission settings, wherein the MWD transceiver and the rig transceiver are configured to communicate when the one or more MWD transmission settings and the one or more rig transmission settings are synchronized, and wherein the MWD transceiver and/or the rig transceiver are further configured to:

transmit, from the MWD transceiver to the rig transceiver, the MWD data;

determine, from the MWD data received by the rig transceiver, a rig transmission setting adjustment;

adjust the one or more rig transmission settings according to the rig transmission setting adjustment; and adjust the one or more MWD transmission settings, wherein the adjusted one or more rig transmission settings and the adjusted one or more MWD transmission settings are synchronized.

10. The system of claim 9, wherein the rig transceiver is configured to provide setting data to the MWD transceiver to define the one or more MWD transmission settings, and wherein the MWD transceiver and/or the rig transceiver are further configured to:

transmit current setting data from the rig transceiver to the MWD transceiver in response to the adjusting the one or more rig transmission settings, wherein the adjusting the one or more MWD transmission settings is in response to the MWD transceiver receiving the current setting data; and communicate data between the MWD transceiver and the rig transceiver according to the adjusting one or more rig transmission settings and the adjusting one or more MWD transmission settings.

11. The system of claim 9, wherein the MWD data comprises delays caused by time between symbols (TBS) inserted into the MWD data.

12. The system of claim 11, wherein the rig transceiver is further configured to:

identify the delays caused by the TBS; and determine the rig transmission setting adjustment in response to the identifying the delays caused by the TBS.

13. The system of claim 11, wherein the delays are between portions of the MWD data.

14. The system of claim 11, wherein the TBS effectively changes a transmission rate of the MWD data to a first data rate, and wherein the adjusting one or more rig transmission settings and the adjusting one or more MWD transmission settings causes the rig transceiver and the MWD transceiver to communicate at a second data rate substantially similar to the first data rate.

15. The system of claim 11, wherein the TBS is inserted into the MWD data in response to a battery level of the MWD transceiver.

16. The system of claim 11, wherein the adjusting one or more rig transmission settings and/or the adjusting one or more MWD transmission settings comprise one or more of changed telemetry channels, changed pulse width, changed frequency, or adjusted the time between the symbols.

17. A method comprising:

transmitting, from a measurement while drilling (MWD) transceiver to a rig transceiver, parameter data associated with one or more MWD transmission settings, wherein the parameter data comprises instructions for the rig transceiver to select one or more rig transmission settings and for the rig transceiver to transmit setting data to the MWD transceiver;

receiving, with the MWD transceiver, the setting data from the rig transceiver in response to the transmitting the parameter data; and selecting the one or more MWD transmission settings in response to the receiving the setting data, wherein the selected one or more MWD transmission settings and the selected one or more rig transmission settings are synchronized.

18. The method of claim 17, wherein the parameter data is transmitted during a first time period and the setting data is received during a second time period after the first time period, and wherein the parameter data defines the second time period.

19. The method of claim 17, wherein the parameter data is a portion of MWD data transmitted from the MWD transceiver to the rig transceiver.

20. The method of claim 17, wherein the parameter data is configured to adjust a setting associated with power usage of the rig transceiver and/or the MWD transceiver.

* * * * *